United States Patent [19]

Pedgonay

[11] Patent Number: 4,644,704

[45] Date of Patent: Feb. 24, 1987

[54] RAIN GUTTER DEBRIS ELIMINATOR

[76] Inventor: John S. Pedgonay, 53 E. Bel Air Ave., P.O. Box 127, Aberdeen, Md. 21001

[21] Appl. No.: 798,907

[22] Filed: Nov. 18, 1985

[51] Int. Cl.[4] ..... E04D 13/06

[52] U.S. Cl. ..... 52/12

[58] Field of Search ..... 52/12; 210/474

[56] References Cited

U.S. PATENT DOCUMENTS

| | | | |
|---|---|---|---|
| 2,209,741 | 7/1940 | Sullivan et al. | 210/474 |
| 2,423,923 | 7/1947 | Audino | 52/12 |
| 3,295,264 | 1/1967 | Olson | 52/12 |
| 4,573,290 | 3/1986 | Fleming | 52/12 |

FOREIGN PATENT DOCUMENTS

| | | | |
|---|---|---|---|
| 479848 | 1/1952 | Canada | 52/12 |
| 18587 | of 1889 | United Kingdom | 52/12 |

*Primary Examiner*—Leslie A. Braun
*Assistant Examiner*—John Malcolm White
*Attorney, Agent, or Firm*—John F. McClellan, Sr.

[57] ABSTRACT

A system for preventing debris from a sloping roof from clogging a gutter provides a panel of fine screening such as insect screening stretched taut between an upper margin cemented to a roof and a lower margin cemented to the outer edge of a gutter. A plurality of resilient tubular spacers in parallel downward array beneath the screening space it from the roof, causing water to flow through the screening and pass down the roof between the screening and roof. Water is retarded in the process, inhibiting overshoot of the gutter. Water may drop directly into the gutter at the lower border; the lower border is steeper in slope than other portions to shed debris better.

10 Claims, 3 Drawing Figures

RAIN GUTTER DEBRIS ELIMINATOR

FIELD OF THE INVENTION

This invention relates generally to buildings and particularly to a system for preventing debris from clogging gutters and downspouts of sloping roof buildings.

BACKGROUND OF THE INVENTION

Because clogged gutters and downspouts can cause rainwater backup and damage to buildings and defeat the intended purpose of safe diversion of the water, protective screens have been used.

Typically, these are of hardware cloth (sometimes called "rat wire") with quarter-inch to half-inch (6 mm to 12 mm) mesh heavy enough to support a mass of wet leaves. On seeing such accumulation, the homeowner or other person responsible must climb up and remove the debris, at some risk of falling and with some loss of time.

Coarseness of the mesh permits stems and fragments to penetrate it and hang, and in part to drop through into the gutters when clearing is attempted, making the screen and gutters difficult to clean. Further, the gutters must sustain a load of debris and water and heavy mesh for which they are not intended. In mild weather insects such as mosquitos may breed in the gutters in pools formed by incomplete drainage.

Should the heavy hardware cloth blow loose, it can cause injury and short-circuit electric lines. Being usually of galvanized steel, it can cause electrolytic reaction with aluminum gutters.

SUMMARY OF THE INVENTION

A principal object of this invention is to provide a rain gutter debris eliminator system that substantially eliminates also the problems described above and others associated with old-art systems of the type.

Further objects in detail are to provide a system as described that:

- employs gutter bridging structure with a mesh so fine and a contour so smooth that it serves as a filter to shunt-off all gross debris, but that passes water freely into the gutter being shielded;
- uses any wet chaff to slow passage of water over the screen for best diversion of water into the gutter, but that permits the wind to remove any dry chaff or similar debris collected on the screen;
- although of fine mesh, inhibits overshoot of water from a sloping roof;
- is easy to attach and detach to and from roof and gutter non-destructively and without modification to either, is easy to trim to fit particular installations, and requires only three types of components;
- is not obtrusive in appearance and is lightweight, durable, low cost, and compact for shipment and for storage as compared with heavy mesh systems.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
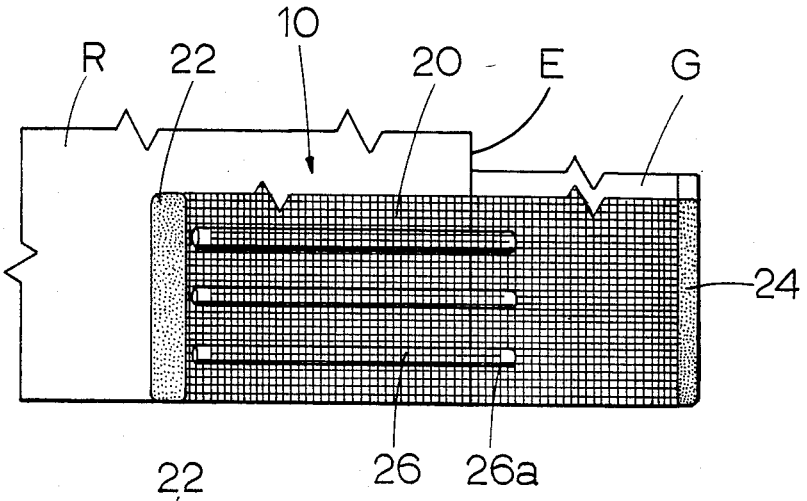
FIG. 1 is a fragmentary plan-detail of an embodiment of the invention installed over a typical roof portion and gutter.
Figure 2:
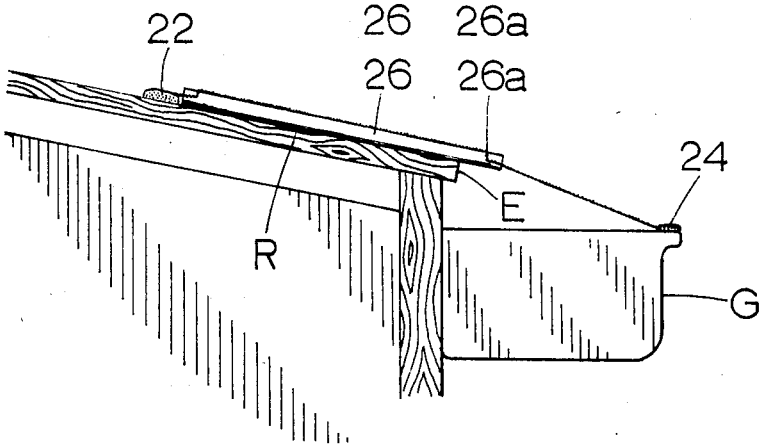
FIG. 2 is a corresponding elevational view thereof.

FIGS. 1 and 2 show embodiment 10 of the invention installed over eaves E and gutter G of a conventional sloped roof R of a dwelling, commercial building or the like.

The invention includes a length of close-mesh panel of screening 20 stretched taut and supported at the upper border between an asphaltic cement coated margin 22 along a portion of the roof and a second asphaltic cement coated margin 24 along the outboard edge of the gutter G, with an intermediate portion of the screening 20 in a plane parallel spaced from the roof R by a plurality of resilient elongate members 26. As will be seen, these members comprise means for causing water to pass between the screening and the roof.

The elongate members 26 may be lengths of tubing such as thin-wall thermoplastic tubing with the proportions customarily used in soda straws, and are affixed all on the underside of the screening in parallel-spacing substantially perpendicular to the margins.

At the upper border, the screening 20 joins the upper ends of the resilient elongate members or elongate tubular members 26 to which it may be mechanically joined and/or cemented, as will be seen.

A terminal portion **26*a* of the downward end of each elongate tubular member may extend about one and one quarter inch (3 cm) beyond the eaves E and provide additional resilient support for the lower border or gutter covering portion of the screening. The gutter covering portion slopes downward from the downward ends 26*a*** of the elongate tubular members for shedding debris better with less flow of water.

Figure 3:
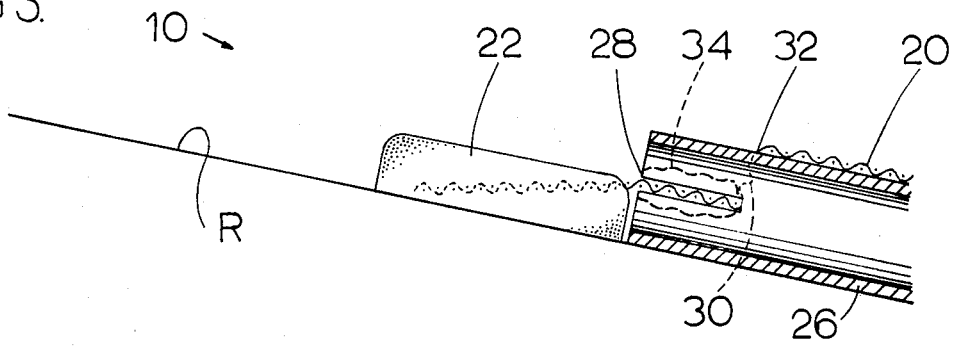
FIG. 3 is an enlarged sectional detail of a portion of the FIG. 2 showing.

FIG. 3 shows on a larger scale a fragment of the first or upper margin 22 and intermediate portion of the embodiment 10 as installed.

Asphaltic cement strip 22 impregnates the margin of the screening 20 and holds it to roof R. The adjacent portion of the screening 20 joins to a slit 28 across the horizontal diameter of each elongate tubular member 26. At the lower end of the slit 28 a transverse slit 30 in the screening 20 permits the screening to be received in the slit 28 and passed over the elongate tubular member as at 32. Slits in the straws may be about 9/32 inch (7 mm) deep; slit spacing in the screening along the straws may be 7¼ inches (18 cm). The straws may be flexed for assembly. The same slit-structure means for holding may be used at each end, affixing the parts together with little possibility of unwanted disassembly. For further security, a small drop of a suitable cement 34 such as amyl acetate may be applied at each slit.

Function is described below in reference to FIGS. 1, 2 and 3 together, and in a summary.

Water washing debris down a roof R tends to push the debris over the smooth or fine-mesh screening 20 to a position at which the water can drop through the screening and flow into the gutter G. Any fine debris accumulated on the mesh helps slow the water, which percolates downward through it.

When dried, the fine debris can blow away. Water passing over the elongate tubular portions can sink between them and pass into the gutter G; any excess flow will be slowed by the screening and will pass through it en route toward the gutter where the steeper downward slope of the screening will tend to eject debris over the edge, clearing the screening so that water will not shunt over it but will pass down through it.

In an embodiment made, installed, and tested under hurricane conditions (Gloria, 1985) on a house in a wooded area in Maryland, this embodiment functioned perfectly, as described above, and sustained no damage.

Used were plastic soda-straws 15/64 inch (6 mm) in diameter by 7¾ inches (20 cm) long with 0.006 inch (01.5 mm) wall thickness, together with plastic-coated fibreglass screening having 0.007 inch ( 0.15 mm) strands and mesh 16×18 to the inch (7×7 to the centimeter approximately).

The soda straws were installed 3 inches (7.5 cm) on center with a mastic upper margin of 1 inch (2.5 cm). The lower margin was approximately 3 inches (7.5 cm) with a mastic border of one-half inch. Any suitable mastic type cement may be used, preferably a non-hardening type if easy removal is desired, applied over and under the screening.

Mesh spacing should be not much finer than the 16 to 18 to the inch spacing described, to avoid excessive sluffing-off of water on steeper-pitch roofs. The roof used in the test described had a pitch of approximately 14 degrees.

In summary, as to embodiment 10:

1. The mesh is a filter.

2. The space between the mesh and roofing gets the water off (below) the mesh to disrupt the tendency to follow the mesh over the gutter.

3. The gutter is closed to debris larger than the mesh opening.

4. The mesh-to-roof space is preserved at roof edge and between spacers.

5. Debris on mesh slows flow to enhance mesh penetration.

6. Debris is subject to removal by wind, which is aided by smoothness of mesh surface.

It will be appreciated that the exact sizes and spaces of the components given does not set down the only sizes and spaces usable, but rather a range. For example, the screening should not sag to the roof between supports, and the mesh spacing may be coarser than given, but in any event should be closer to sixteen to the inch than to quarter-inch mesh spacing. Insect screening is to be preferred. This invention contemplates that fine screening will clog less than coarse screening in the application described.

This system does not use downspout screens in the gutter over the downspout, and does not use downspout debristraps with fork-like appendages to shunt coarse debris through an opening in the side of the downspout.

For clarity, the Figures do not show a roof with overlapped shingles, but the invention works well on over lapped-shingle roofs.

This invention is not to be construed as limited to the particular forms disclosed herein, since these are to be regarded as illustrative rather than restrictive. It is, therefore, to be understood that the invention may be practiced within the scope of the claims otherwise than as specifically described.

For example, the term "elongate tubular members" may include for the purposes herein substantially solid rods.

What is claimed and desired to be protected by United States Letters Patent:

1. A system for shielding a gutter with an outer edge, installed along the eaves of a sloping roof, from clogging with waterborne debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including a plurality of separate means between the upper border and lower border for holding intermediate portions of the panel of screening in an upward position, and said holding of intermediate portions of the panel of screening including holding said screening in a plane parallel-spaced relative to said roof for passage of water therealong beneath said panel of screening, and the plurality of means for holding comprising a plurality of members having substantially uniform parallel spacing from each other along the length of said roof.

2. A system for shielding a gutter with an outer edge, installed along the eaves of a sloping roof, from clogging with water-borne debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including a plurality of means between the upper border and lower border for holding intermediate portions of the panel of screening in an upward position, and said holding of intermediate portions of the panel of screening including holding said screening in a plane parallel-spaced relative to said roof for passage of water therealong beneath said panel of screening, the plurality of means for holding comprising a plurality of elongate members having substantially uniform parallel spacing from each other along the length of said roof, and said members comprising elongate tubular members.

3. A system as recited in claim 2, means for fastening the elongate tubular members to the panel of screening comprising slit-defining structure in the panel of screening engaging slit-defining structure in said elongate tubular members for fixing said elongate tubular members in downward alignment with a said roof.

4. A system as recited in claim 2, said elongate tubular members being resilient.

5. A system as recited in claim 2, said elongate tubular members being of thermoplastic material.

6. A system for shielding a gutter with an outer edge, installed along the eaves of a sloping roof, from clogging with water-borne debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including means between the upper border and lower border for holding intermediate portions of the panel of screening in an upward position, said holding of intermediate portions of the panel of screening including holding said screening in parallel spacing relative to said roof for passage of water therealong beneath said panel of screening, the means for holding comprising a plurality of members having substantially uniform spacing from each other along said roof, said members comprising elongate tubular members, and said elongate tubular members proportioned for extending in a downward direction beyond the eaves of a said roof.

7. A system for shielding a gutter with an outer edge, installed along the eaves of a sloping roof, from clogging with water-borne debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including means between the upper border and lower border for holding intermediate portions of the panel of screening in an upward position, said holding of intermediate portions of the panel of screening including holding said screening in parallel spacing relative to said roof for passage of water therealong beneath said panel of screening, the means for holding comprising a plurality of members having substantially uniform spacing from each other along said roof, said members comprising elongate tubular members, and said panel of screening proportioned for sloping down from said elongate tubular members over the gutter.

8. A system for shielding a gutter with an outer edge, installed along the eaves of a sloping roof, from clogging with water-borne debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including a plurality of means between the upper border and lower border for holding intermediate portions of the panel of screening in an upward position, and said holding of intermediate portions of the panel of screening including holding said screening in a plane parallel-spaced relative to said roof for passage of water therealong beneath said panel of screening, the plurality of means for holding comprising a plurality of elongate tubular members having substantially uniform parallel spacing from each other along the length of said roof and the substantially uniform parallel spacing of said elongate tubular members being about three inches (7.5 cm).

9. A system for shielding a gutter with an outer edge, installed along the eaves of a sloping roof, from clogging with water-borne debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including a plurality of separate means between the upper border and lower border for holding intermediate portions of the panel of screening in an upward position, the panel of screening having mesh spacing closer to one and one half millimeters than to six millimeters.

10. A system for shielding a gutter with an outer edge, installed along the eaves of a sloping roof, from clogging with water-borned debris from the roof, while assuring collection of said water in the gutter, comprising: a panel of screening with an upper border and a lower border, means for affixing the upper border along a said sloping roof substantially parallel with and spaced up the roof from a said gutter, means for affixing the lower border along the outer edge of a said gutter, means for causing said water to pass between the panel of screening and a said roof, including means between the upper border and the lower border for holding intermediate portions of the panel of screening in an upward position, said holding of intermediate portions of the panel of screening including holding said screening in parallel spacing relative to said roof for passage of water therealong beneath said panel of screening, the means for holding comprising a plurality of members having substantially uniform spacing from each other along said roof, said members comprising elongate tubular members, means for fastening the elongate tubular members to the panel of screening comprising slit-defining structure in the panel of screening engaging slit-defining structure in said elongate tubular members for fixing said elongate tubular members in downward alignment with a said roof and means for adhering said elongate tubular members to said screening at said slit defining structure.

* * * * *